US006709272B2

(12) United States Patent
Siddle

(10) Patent No.: US 6,709,272 B2
(45) Date of Patent: Mar. 23, 2004

(54) METHOD FOR FACILITATING FIREARMS TRAINING VIA THE INTERNET

(76) Inventor: Bruce K. Siddle, 6934 State Rte. 163, Millstadt, IL (US) 62260

( * ) Notice: Subject to any disclaimer, the term of this patent is extended or adjusted under 35 U.S.C. 154(b) by 238 days.

(21) Appl. No.: 09/924,087

(22) Filed: Aug. 7, 2001

(65) Prior Publication Data

US 2003/0031986 A1 Feb. 13, 2003

(51) Int. Cl.[7] ..... F41G 3/00; F41G 3/26

(52) U.S. Cl. ..... 434/21; 434/16; 434/23; 273/348; 463/51

(58) Field of Search ..... 434/11, 16–24, 434/365; 273/348; 703/17, 2, 20; 345/158, 156, 419, 420; 372/16, 11, 21; 463/37, 51

(56) References Cited

U.S. PATENT DOCUMENTS

| | | | | | |
|---|---|---|---|---|---|
| 4,948,371 | A | * | 8/1990 | Hall | 434/21 |
| 5,328,190 | A | | 7/1994 | Dart et al. | |
| 5,566,951 | A | | 10/1996 | Dart et al. | |
| 5,577,733 | A | * | 11/1996 | Downing | 273/348 |
| 5,816,817 | A | | 10/1998 | Tsang et al. | |
| 5,941,708 | A | * | 8/1999 | FitzGerald | 434/16 |
| 6,106,297 | A | * | 8/2000 | Pollak et al. | 434/16 |
| 6,322,365 | B1 | * | 11/2001 | Shechter et al. | 434/21 |
| 6,360,193 | B1 | * | 3/2002 | Stoyen | 703/17 |
| 6,545,661 | B1 | * | 4/2003 | Goschy et al. | 345/158 |
| 2002/0012898 | A1 | * | 1/2002 | Shechter et al. | 434/21 |
| 2002/0051953 | A1 | * | 5/2002 | Clark et al. | 434/16 |
| 2002/0057719 | A1 | * | 5/2002 | Shechter | 372/16 |
| 2002/0197584 | A1 | * | 12/2002 | Kendir et al. | 434/21 |

OTHER PUBLICATIONS

Representative pages from http:/www.en–mark.com; Jul. 6, 2001.
Representative pages from http:/www.beamhit.com; 1999.
"Simulated Shooting Means Stimulated Sales" By T. Goral, http:/www.rangeinfo.org; May 1998.
Representative pages from http:/www.ies.com; Jul. 6, 2001.
Representative pages from http:/www.fatsinc.com; 1999.

* cited by examiner

*Primary Examiner*—Joe H. Cheng
(74) *Attorney, Agent, or Firm*—Thompson Coburn, LLP

(57) ABSTRACT

A method for facilitating firearms training is provided. The method comprises using a client computer system to access via the Internet a retrieval system on a host computer system. The retrieval system is adapted to retrieve a firearms training simulation stored in a computer database upon receiving a signal. The firearms training simulation is adapted to train a trainee in using a firearm. The method further comprises inputting the signal in a manner such that the retrieval system retrieves the firearms training simulation from the database and transfers it to the client computer system in a manner sufficient for the firearms trainee to train with the firearm.

11 Claims, 5 Drawing Sheets

METHOD FOR FACILITATING FIREARMS TRAINING VIA THE INTERNET

BACKGROUND OF THE INVENTION

The present invention pertains to methods for facilitating firearms training via the Internet.

Conventional firearms training simulators are used by law enforcement and other security agencies to train their personnel in the use of firearms. Typically, the simulators use audio/visual presentations that enable the trainee to develop marksmanship or targeting skills and/or judgmental skills in employing a firearm. The simulations are generally video depictions of a real life situation that a trainee might encounter while in the line of duty. A simulation may include one or several scenarios that test the trainee in selectively employing the firearm and targeting the firearm when it is employed. There are several systems commercially available to provide such training, including the Range2000 offered by IES Electronic Industries USA, Inc. of Littleton, Colo.; FATS provided by En-Mark, Inc. of Pendleton, Ind.; and the CST 100D-P provided by Firearms Training Systems, Inc. of Suwanee, Ga.

Generally, the systems in the prior art are self-contained simulators in which the manufacturer provides the complete simulation environment, including a room, a large screen projector for displaying the simulations, effects, a firearm that is designed to interact with the simulation, and a system to deliver the training simulation and display it on the screen. Some manufacturers provide the simulator system in a portable, self-contained, mobile trailer that may be leased or rented on a periodic basis by security and law enforcement agencies. The mobile trailer may be brought on-site to train agency personnel. Typically, the simulators have a library of several types of simulations so as to provide training for personnel in a variety of situations and scenarios. To effectively train agency personnel, updated simulations are provided by the manufacturer. The updates enable personnel to see a variety of situations and scenarios which broadens the trainee's skill level and prevents the trainee from anticipating the events that will transpire in a particular scenario.

Although the firearms training simulator systems of the prior art are effective in training personnel in the use of a firearm, the firearms training simulator systems of the prior art have several disadvantages. Firearms training simulator systems have an initial capital expense which is often too costly for small agencies to afford. Some agencies also lack the space needed to locate a permanent firearms training simulator facility.

Although several manufacturers provide a mobile firearms training simulator facility, the rental fee for the mobile facility is also often too expensive for a small agency to afford. Many times, several agencies group together and combine resources to lease and share a mobile training simulator. However, different agency personnel working on different shifts must be scheduled through the firearms training simulator facility during the limited time in which it is available. Often this period of availability conflicts with the schedule of some agency personnel preventing some of the personnel from training at all with the simulation. Frequently, when the mobile firearms training simulator is available for a limited time, only a few simulations can be run for the trainees. This also detracts from the training value and overall effectiveness of the firearms training simulator system.

To sharpen the skills of personnel training in a firearms training simulator system, updated simulations with new scenarios must be continuously provided to enable the trainee to experience a variety of different situations and encounters. The updated scenarios also sharpen marksmanship and decision-making skills. Although manufacturers provide updates, the updates are commonly a recurring cost that agencies cannot afford. Additionally, when there are technical problems with the firearms training simulator system, manufacturing repair representatives must go on-site to provide technical training, troubleshooting, repair, and other services. This also increases the expenses associated with the firearms training simulator systems and frequently strains the operating budget of the agency.

SUMMARY OF THE INVENTION

The present invention overcomes many of the disadvantages found in the prior art by providing a system for displaying, distributing, and training personnel in the use of a firearm. In this regard, the present invention accomplishes the aforesaid goals by providing a system that enables the law enforcement and security agencies to train their personnel in a more cost effective manner. Personnel working on different shifts may train at different times of the day. Municipalities are not forced to group together to purchase limited rental time on a mobile firearms training simulator system. Moreover, the present invention provides a method of updating simulations and tracking trainee performance in a centralized and organized manner.

Among the objects and advantages of the present invention may be noted the provision of a method for providing firearm training simulators via the Internet. The provision of such a method enables a trainee to train in the use of a firearm through a firearms training simulator provided over the Internet. Additionally, such a method provides distribution of a firearms training simulation to several trainees via the Internet.

One aspect of the present invention comprises a method for facilitating firearms training. The method comprises using a client computer system to access via the Internet a retrieval system on a host computer system. The retrieval system is adapted to retrieve a firearms training simulation stored in a computer database upon receiving a signal. The firearms training simulation is adapted to train a trainee in using a firearm. The method further comprises inputting the signal in a manner such that the retrieval system retrieves the firearms training simulation from the database and transfers it to the client computer system in a manner sufficient for the firearms trainee to train with the firearm.

Another aspect of the present invention comprises a method for facilitating firearms training. The method comprises using a client computer system to access a host computer system via the Internet. The host computer system has a database and a firearms training simulation stored in the database. The firearms training simulation is adapted to train a trainee in using a firearm. The method further comprises retrieving the firearms training simulation stored in the database on the host computer system, transferring the firearms training simulation from the host computer to the client computer system, and operating the client computer system in a manner sufficient to train the firearms trainee with the firearm. An interactive device operatively connected to the client computer system is provided for the firearms trainee to use when interacting with the training simulation. The interactive device is adapted to generate interactive data when the trainee operates the interactive device during operation of the training simulation. The method further comprises training the trainee in handling the firearm and collecting at least a portion of the interactive device data to generate a trainee performance score that is at least in part indicative of an effectiveness of the trainee interacting with the training simulation.

Another aspect of the present invention comprises a method for facilitating firearms training. The method comprises storing a firearm training simulation in a database of a host computer system. The firearms training simulation is sufficient to train a trainee in the use of a firearm. The host computer system is provided with a retrieval system adapted to enable a client computer system to retrieve the firearms training simulation from the database when the client computer system accesses the host computer system through the Internet. The method further comprises retrieving the firearms training simulation from the database through the retrieval system upon receipt of a signal from the client computer system, and transferring the training simulation from the host computer system to the client computer system upon execution of a command at the client computer system.

Other objects and features of present invention will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
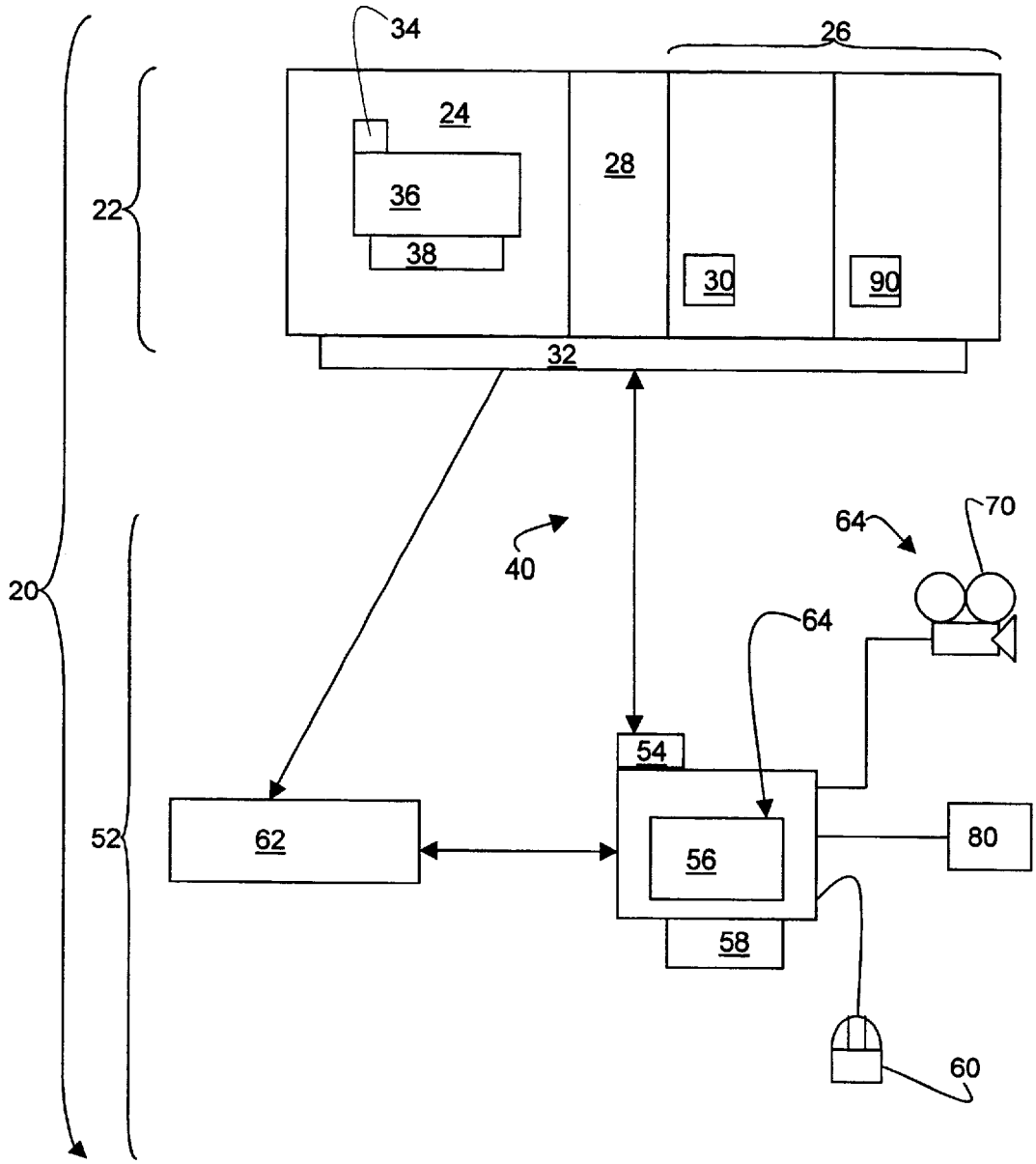
FIG. 1 is a simplified block diagram of a computer system of the present invention.
Figure 2:
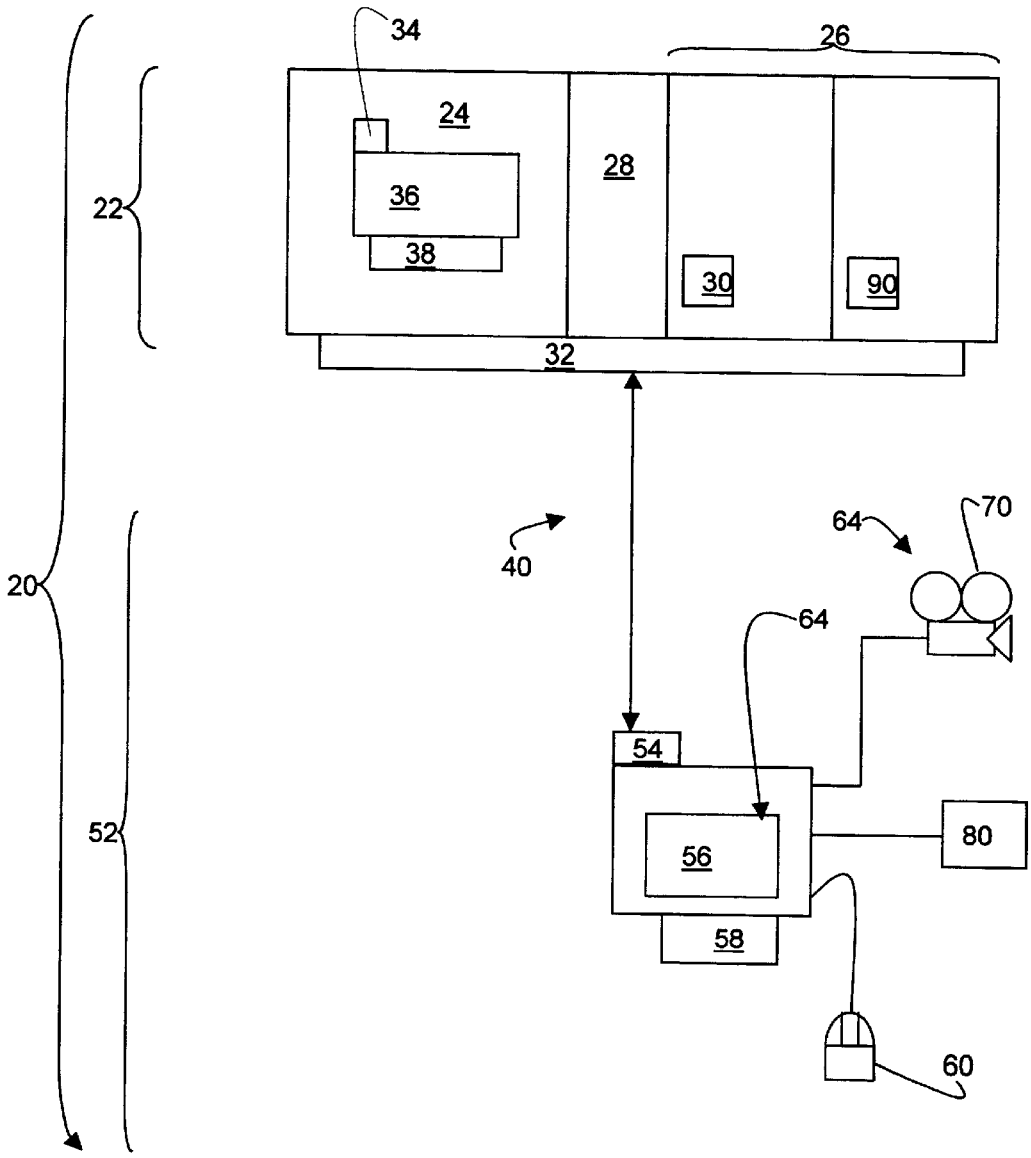
FIG. 2 is an alternate embodiment of the computer system of the present invention.

FIGS. 1 and 2 are simplified block diagrams of a computer system, generally indicted at 20, of the present invention. The computer system 20 comprises a host computer system 22. The host computer system 22 comprises a centralized video server 24, a computer database 26, and a retrieval system 28 that enables an Internet user to retrieve a firearms training simulation 30 from the host computer system 22. The centralized video server 24 is shown as a conventional computer system, rather generically comprising a network coupling device 32 of a suitable type, such as a high-speed analog or digital modem, a central processing unit (CPU) 34, and a display 36 and keyboard 38 for operator interaction. It should be understood that various means for entering data and observations other than keyboards are known. Such devices may include light pens, pointing devices such as a computer mouse, touch screens, or even microphones or video cameras or any other data input device, all of which can be configured to serve a function equivalent to a keyboard for purposes of this invention.

The centralized video server 24 may, itself, be a computer network instead of the simple system shown in FIGS. 1 and 2. In particular, the centralized video server may comprise one or more separate web servers and/or separate databases with extensive RAM and disk memory storage, or their functional equivalents. The centralized video server 24 is provided with firewall hardware installed thereon as is common in the art. Although not shown in FIGS. 1 and 2, portions of such a video server network may be physically separate from one another, and these portions may communicate with each other over the Internet or over a separate network. The centralized video server 24 is preferably functionally coupled to the Internet 40 and thus to client computer systems 52 via one or more dedicated, high-speed lines. The requirements for the server and high-speed line are dictated at least in part by the expected volume of data to be exchanged with users at client computer systems and by the number of such client computer systems and users that are expected to access server.

The host computer system 22 is adapted to be connected to the Internet 40. The host computer system 22 (including centralized video server) and its network connection are preferably selected based upon their anticipated peak loading requirements. As an example of a starting point from which to specify a server and a network connection suitable for use with the invention, high-speed connection could be a standard T1-type connection to the Internet provided by an Internet Service Provider (ISP). The server itself could comprise dual INTEL® Pentium® 4 processors. The web server software could be any that allows the server to communicate via a standard protocol. On the Internet, this would include the well-known TCP/IP and Web-based (HTTP, SHTTP) protocols. Examples of such servers are NETSCAPE® Server 3.0 and MICROSOFT® Internet Information Server (IIS). Preferably, the centralized video server 24 will also comprise a hardware database server (not separately shown in FIG. 1). A person skilled in the art, upon understanding the nature of the inventive system and given the implementation details, would be able to select and configure appropriate server hardware. The database software should preferably be sufficiently fast and powerful to handle the anticipated user volume. Preferably, database software that may be useful in conjunction with the invention is produced by Oracle Software and Microsoft Corporation, and may include, for example, MS SQL Server.

The computer system 20 of the present invention also includes a client computer system 52 that is adapted to be in connection with the host computer system 22 through the Internet 40. The client computer system 52 has a network coupling device 54 that enables the client computer system 52 to be coupled to the Internet. Depending upon the type of network connection, a modem may be used to couple the client computer system to the Internet via a telephone line. As is conventional at present, the client computer system 52 is shown as a conventional personal computer system including a display 56, a keyboard 58, and a mouse 60. Such a personal computer system is preferably an INTEL® PENTIUM® based personal computer equipped with 128 MB RAM, 100 MB Ethernet, DVD Player and a 4 GB Hard Drive. The client computer system 52 is located on site at a law enforcement or security agency and is preferably a computer system that is dedicated solely for the agency's use in training simulations. In a commercially successful computer system 20 of the present invention, it is anticipated that there would be large numbers of client computer systems of various different types in communication with the host computer system 22.

Depending upon the format of transmission of the training simulation, the client computer system 52 may also be equipped with a local video storage/distribution system 62 or other similar means that is capable of processing a compressed transmission from the host computer system 22 into a form compatible with the requirements of the client computer system 32. The local video storage/distribution system 62 may be integral with the client computer system or attached thereto, as shown in FIG. 1. A suitable local video storage/distribution system 62 is commercially available and may include that provided by Cisco Systems, Inc. of San Jose, Calif. Preferably, such a localized video storage drive would be capable of storing a minimum of 15 hours of video. The client computer system 52 may also be equipped with the means to accept a complete download of the training simulation from host computer system to the client computer system. The client computer system 52 may also be adapted to accept steady streaming of the training simulation over the computer network from the host computer system through a T1 type link or DSL link or other high speed link capable of receiving broadband transmission.

Preferably, the host computer system database 26 is provided with several training simulations 30. The training simulation 30 is designed to train the trainee in using a firearm. The simulation 30 may train the trainee in developing marksmanship skills. The simulation 30 may also be designed to train the trainee in developing judgmental skills, including developing the trainee's perception of a situation, and recognition and timing when employing the firearm. The training simulation 30 creates a stressful environment for the trainee where the trainee must judge where, when, and how to employ the firearm. The training simulations 30 are also typically tailored for a particular type of mission and/or duty to which the trainee is assigned. For instance, the training simulation may include scenarios depicting real life situations in which trainees may find themselves while in the line of duty, for instance, domestic violence or robbery/burglary, narcotics, gangs, etc.

The training simulations 30 may be created through a film production. Actors are used to act out the various roles in a scripted scenario based on previous real life encounter. The training simulation 30 may then be digitally formatted and stored in the database 26 of the host computer system 22. The training simulation 30 may include a visual and/or audio presentation. The training simulation 30 may be passive wherein the trainee only trains by observing the presentation of the training simulation 30. The training simulation 30 may also be active wherein the trainee interacts with the training simulation. The training simulation 30 may also be adapted to allow more than one trainee to train together at the same time.

The training simulation 30 may also comprise several scenarios that are connected together to create a complex training simulation. A "decision tree" model may be used to connect several scenarios together. In such a training simulation 30 a pre-selected response is associated with a particular scenario and several branches stemming the particular scenario are created depending upon the trainee's response with the scenario and the pre-selected response associated therewith. In this way, the training simulation 30 may change in accordance with a trainee's interaction with the simulation. It should be understood that other models may used to create the branching desired for a particular type of training simulation.

Typically, training simulations 30 may be complex wherein the training simulation includes an audiovisual presentation of a scenario in which the trainee is confronted with the decision where, when, and how to employ the firearm. Accordingly, the training simulation 30 may include a scenario in which the trainee must target a firearm at an object displayed in the training simulation. Depending upon the training scenario and the type of client computer system 52, the extent of the trainee interaction with the training simulation may vary, as will become apparent to the skilled artisan from the discussion that follows.

Figure 3:
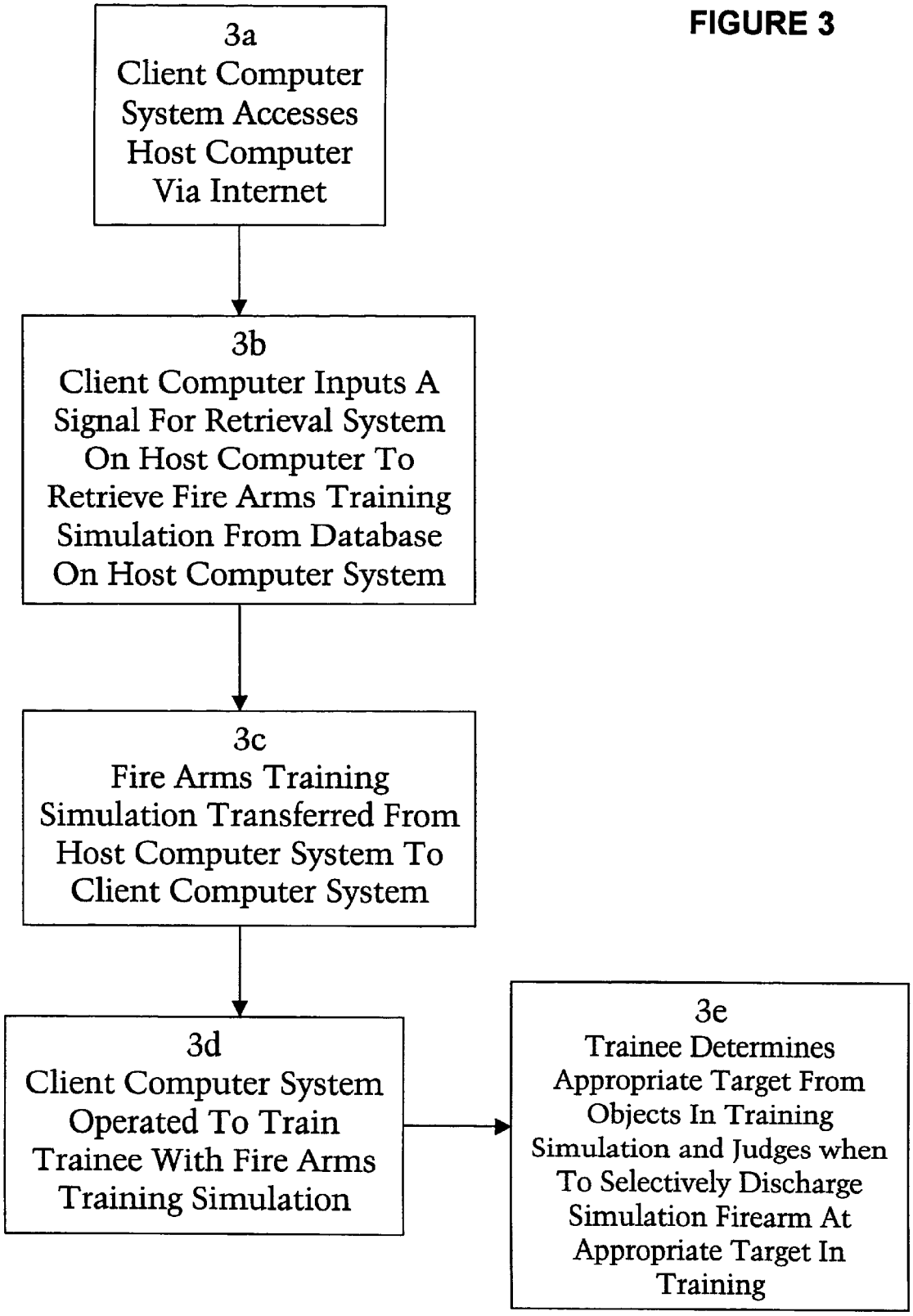
FIG. 3 is flow chart showing the steps of the method of using a client computer system to access via the internet a retrieval system on a host computer system and a fire arms training simulation stored in a database thereon.

FIG. 3 provides a flowchart of one embodiment of the invention of the steps for accessing a firearms training simulation from the host computer. Using the client computer system 52 via the Internet 40 a retrieval system 28 on a host computer system 22 is accessed. Block 3*a*. A signal from the client computer system 52 is then inputted such that the retrieval system 28 retrieves the firearms simulation 30 from a computer database 26 on the host computer system 22. Block 3*b*. The firearms training simulation 30 is then transferred from the host computer system 22 over the internet 40 to the client computer system 52. Block 3*c*. The client computer system is then operation to train the trainee with the firearms training simulation. Block 3*d*. The trainee determines an appropriate target from the objects displayed in the training simulation and judges when to selectively discharge the firearm at the appropriate target displayed in the training simulation. Block 3*e*.

Preferably, the client computer system 52 is provided with means 64 to display the training simulation in a manner sufficient to train the trainee in using the firearm. Such means 64 may include the computer system display 56. Preferably, however, the training simulation is projected onto a screen through use of a video projector 70 to more closely simulate the size and distances of objects that the trainee would encounter while in the line of duty.

Preferably, the client computer system 52 is provided with an interactive device 80 to assist in training the trainee. The type of interactive device 80 used in the client computer system 52 is in part dependent upon the type of training simulation, as will be discussed later. As shown in the drawing figures, the interactive device 80 is connected to the client computer system 52. Such connection may be made through the client computer's parallel ports and/or universal serial bus (USB) connections. Although not shown in the figures, the interactive device 80 may be a separate element not at all connected to the client computer system 52.

Among the different types of interactive devices 80 is the firearm itself. Preferably, the firearm is in the form of a handgun, although rifles and shotguns may be used by the trainee depending upon the type of the training simulation used. Preferably, the firearm is capable of discharging both live and blank rounds. It is contemplated that the trainee would be able to train with a firearm personally issued to the trainee. To provide a safe environment but one that closely simulates the situation in which a trainee may find themselves while in the line of duty, the firearm preferably discharges blank rounds during simulation. The firearm may also be connected to the client computer system 52, although under several training simulations contemplated by the inventor, such a connection is not necessary. When the firearm is connected to the client computer system 52, it is preferred that the firearm be equipped with a targeting system. Accordingly, when the trainee targets the firearm at an object in the simulation 30 and discharges the firearm, targeting information or data is generated. This targeting information may then be collected, correlated to the object's relative position in the training simulation and processed to determine the trainee's accuracy and/or timing in employing the firearm.

The client computer system 52 may be provided with means to collect the targeting information. The client computer system 52 may be configured to correlate or process the targeting information or the targeting information may be collected by the client computer system and transmitted to the host computer system for correlation and processing. Several commercial embodiments of firearms with targeting systems equipped therewith include those provided by Beamhit™ 110 System offered by Beamhit, LLC. of Columbia, Md.

In another type of training simulation 30 contemplated by the inventor, the trainee targets and discharges the firearm at an object displayed in the training simulation 30. Such a training simulation is configured to train the trainee in judgmental use of the firearm including situation recognition, perception, and, if necessary firing (simulated or actual) of the firearm. Such a firearm need not generate targeting information but only a response indicating discharge of the firearm that may be compared to the pre-selected response associated with the scenario and/or training simulation. Accordingly, the client computer system need only collect and/or process and/or transmit the trainee's response. Additionally, it is contemplated that an effective training simulation may also be provided without actively connecting the firearm to the client computer system 52. In such a training simulation, the trainee's response to the training simulation may be evaluated manually.

The client computer system 52 may also be provided with other types of interactive devices 80 to enhance the training simulation. For example, the client computer system 52 may have an audio receiver system that responds to vocal commands of the trainee. Accordingly, the trainee's responses when interacting with the training simulation may be processed, evaluated, and compared with a pre-selected response of the scenario. The client computer system 52 may be used to activate other auxiliary devices to create effects such as such smoke, light, and sound. These auxiliary devices may be actuated manually at the client computer system or programmed to operate at the direction of the host computer system in accordance with a program timed to coordinate and coincide with events transpiring in the training simulation 30. Such a program may also be adapted to respond to the trainee's interaction with the training simulation.

The client computer system 52 is preferably configured to transmit interactive data generated from the interactive device back to the host computer system 22. The host computer system 22 may process a portion of the interactive data to alter the training simulation in accordance with the pre-selected response associated with the scenario in the training simulation 30 and the trainee's response when interacting with the training simulation 30. This enhances the real life simulation and enables the trainee to develop a particular skill set. Depending upon the trainee's response when interacting with the training simulation, the training simulation 30 may vary in accordance with a predetermined manner. The altered presentation may then be transmitted to the client computer system 52 from the host computer 22 to enhance the simulation effect. This altered presentation may also include providing different audio and/or visual presentations and/or scenarios to the trainee.

Figure 4:
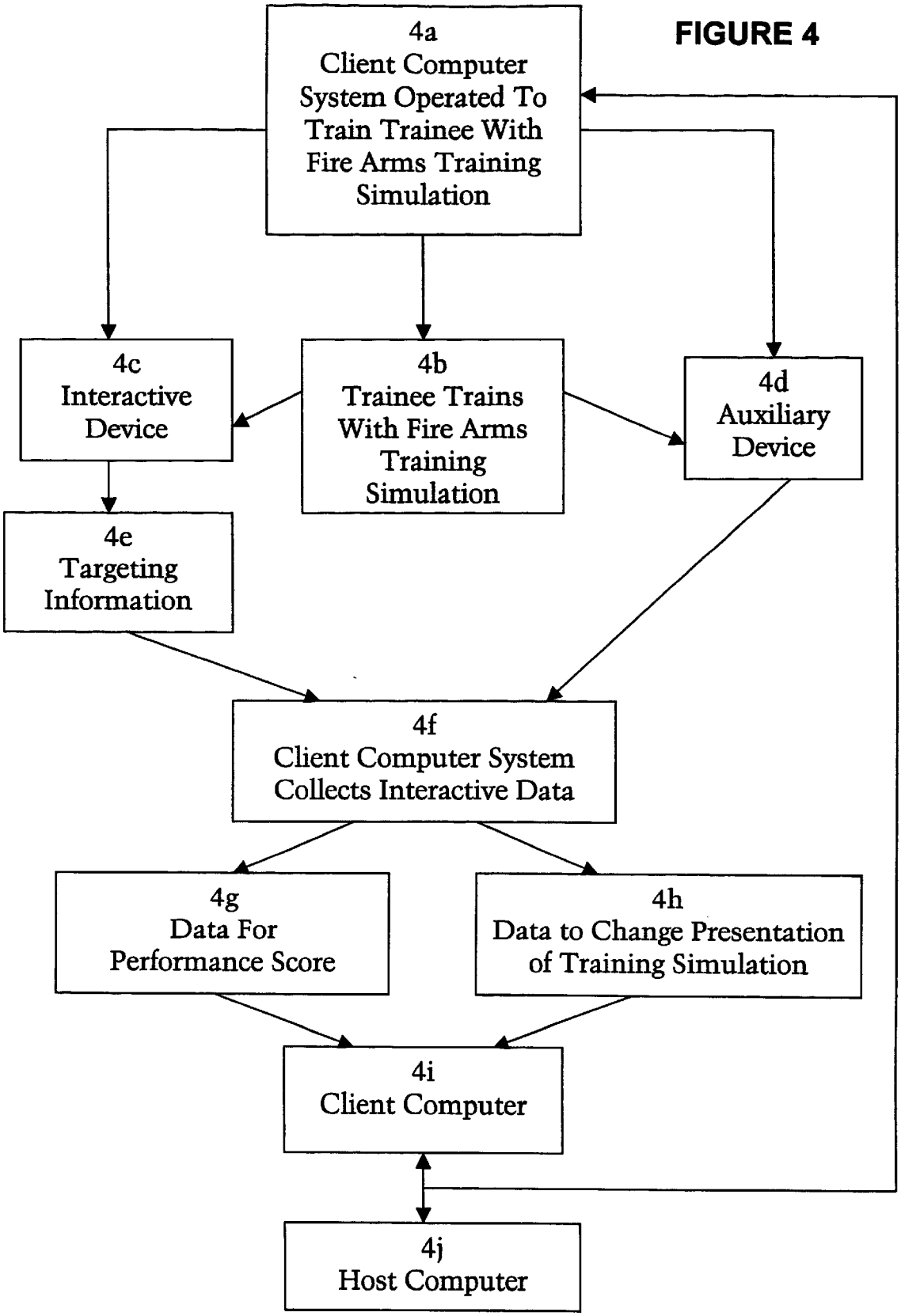
FIG. 4 is a flow chart showing the steps of the method of operating the client computer system to train a trainee with a fire arms training simulation.

FIG. 4 shows a flowchart of one embodiment of the invention of the method of operating the client computer system to train the trainee with the firearms training simulation. The client computer system 52 is operated using one the techniques described above to train the trainee with the fire arms simulation 30. Block 4*a*. The trainee trains with the firearms training simulation in one of the manners described above. Block 4*b*. The trainee may use an interactive device 80 for training (Block 4*c*) and interact with an auxiliary device or second interactive device (Block 4*d*). In one example, the interactive device may be a firearm, which may generate targeting information as set forth above. (Block 4*e*). The targeting data and data from the auxiliary or second interactive device may be collected by the client computer system 52. Block 4*f*. A portion of the data may then be used to create the trainee performance score (Block 4*g*) and a portion may be used to change the presentation of the training simulation (Block 4*h*). The data may be transferred to the client computer system 52 (Block 4*i*) and to the host computer system 22 (Block 4*i*).

A portion of the interactive data may also be collected to generate a trainee performance score. The trainee performance score is indicative of the trainee's effectiveness in interacting with the training simulation. It should be understood that the trainee performance score is generated in a manner that is appropriate for the type of training simulation 30. For example, in a training simulation tailored to train a trainee in marksmanship, the interactive data may include among other information targeting information indicative of the trainee's accuracy in targeting the firearm at an object displayed in the training simulation. Accordingly, the performance score may be based upon the accuracy of the trainee in targeting the firearm. However, it should be understood that other means may be used to develop a meaningful trainee performance score whereby the trainee's performance may be objectively assessed. The performance score may be generated locally at the client computer system 52 or generated remotely at the host computer system 22. The performance score may also be manually generated depending upon the type of training simulation and type of client computer system 52.

In order to provide a further tool to objectively assess the effectiveness of the trainee's interacting with the training simulation, a performance standard may be generated and associated with the training simulation. A portion of the interactive data may then be compared with the performance standard to create trainee performance data 90. The trainee performance data 90 may be at least in part indicative of the trainee's effectiveness in interacting with the training simulation. The trainee performance data 90 may in part include the trainee performance score. The performance standard may be set by an agency in accordance with its own internal guidelines. The performance standard may additionally or alternately be set depending upon a trainee's experience level and a level of difficulty associated with the training simulation. The performance standard may also be a function of the number and types of scenarios contained within a training simulation. The performance standard may also be generated through averaging or other statistical methods using data from a population of several trainees. The performance standard may be maintained in a database of the host computer system or maintained in a database of the client computer system.

The trainee performance data 90 may be collected, tracked, and stored as required by an agency to assist an agency in managing and administering its training program for its personnel. The trainee performance data 90 may be stored in a database of the client computer system 52. The trainee performance data 90 may also be stored in a database 26 of the host computer system 22. In the latter configuration, the host computer system 22 is preferably configured to generate reports presenting the trainee performance data in a variety of selected formats upon commands executed at the client computer system 52. In this way, several trainees' performance scores may be collected, stored, tracked and evaluated, and reports may be produced as required by the agency for internal administrative record keeping. It should be understood that these functions may also be provided at the client computer system 52.

Figure 5:
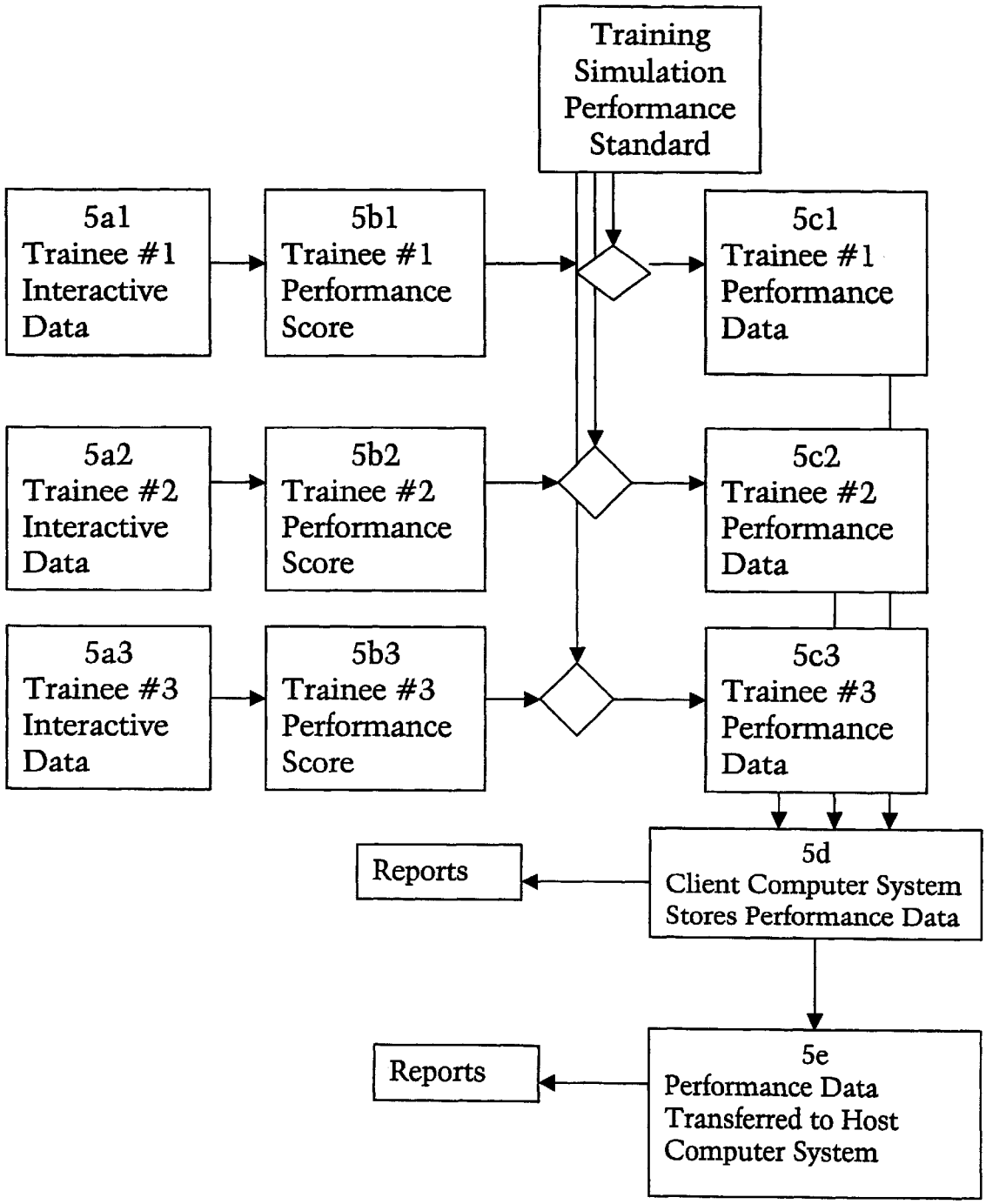
FIG. 5 is a flow chart showing the steps of the method of creating and storing trainee performance data.

FIG. 5 provides a flowchart of one embodiment of the invention of the method of collecting and generating trainee Performance data. Trainee interactive data is collected as the trainee operates the interactive device and trains with the firearms simulation. Blocks 5*a*1 ,5*a*2,5*a*3. A portion of that data may be used to generate a performance score as set forth above. Blocks 5*b*1 ,5*b*2,5*b*3. The trainee Performance score may be compared to the performance standard for the training simulation 30 to create trainee performance data 90. Blocks 5*c*1,5*c*2.5*c*3. The trainee performance data 90 may be collected by the client computer system S2. Block 5*d*. The trainee Performance data may then be transferred to the host computer system 22. Block 5*e*. Reports of trainee performance data may be generated from either the client computer system 52 or the host computer system 22.

In view of the above, it will be seen that the several objects of the invention are achieved and other advantageous results obtained. As various changes could be made in the above constructions and methods without departing from the scope of the invention, it is intended that all matter contained in the above description or shown in the accompanying drawings shall be interpreted as illustrative and not in any limiting sense.

What is claimed is:

1. A method comprising:

providing a client computer system;

using the client computer system to access via the Internet a retrieval system on a host computer system, the retrieval system being adapted to retrieve a firearms training simulation stored in a computer database upon receiving a signal, the firearms training simulation being adapted to train a trainee in using a firearm; and inputting the signal in a manner such that the retrieval system retrieves the firearms training simulation from the database and transfers it to the client computer system in a manner sufficient for the firearms trainee to train with the firearm;

providing a firearm adapted to discharge at least one of live and blank rounds;

operating the client computer system in a manner to train the firearms trainee with the training simulation;

discharging the firearm in response to object displayed in the training simulation;

wherein the training simulation is adapted to train the trainee in determining an appropriate target from the objects displayed in the training simulation and judging when to discharge the firearm, the step of discharging the firearm further comprising selectively discharging the firearm at the appropriate target displayed in the training simulation.

2. A method comprising:

providing a client computer system;

using the client computer system to access a host computer system via the Internet, the host computer system having a database and a firearms training simulation stored in the database, the firearms training simulation being adapted to train a trainee in using a firearm;

retrieving the firearms training simulation stored in the database on the host computer system;

transferring the firearms training simulation from the host computer to the client computer system;

operating the client computer system in a manner sufficient to train the firearms trainee with the firearm;

providing an interactive device operatively connected to the client computer system for the firearms trainee to use when interacting with the training simulation, the interactive device being adapted to generate interactive data when the trainee operates the interactive device during operation of the training simulation;

training the trainee in handling the firearm;

collecting at least a portion of the interactive device data to generate a trainee performance score that is at least in part indicative of an effectiveness of the trainee interacting with the training simulation; and wherein the firearms training simulation is adapted to change in response to the trainee interacting with the training simulation;

the step of training further comprising enabling the interactive device to generate data to change a presentation of the training simulation.

3. The method of claim 2 wherein:

the interactive device includes an audio receiver adapted to respond to voice commands of the trainee, the audio receiver is adapted to generate data corresponding to the trainees voice commands;

the step of training further comprising using the audio receiver data to alter the presentation of the training simulation.

4. A method comprising:

providing a host computer system;

storing a firearm training simulation in a database of the host computer system, the firearms training simulation being sufficient to train a trainee in the use of a firearm; providing a retrieval system on the host computer system adapted to enable a client computer system to retrieve the firearms training simulation from the database when the client computer system accesses the host computer system through the Internet the retrieval system being adapted to retrieve the firearms training simulation stored in the computer database upon receiving a signal from the client computer system;

inputting the signal from the client computer system and retrieving the firearms training simulation from the database through the retrieval system; and transferring the training simulation from the host computer system to the client computer system upon execution of a command at the client computer system;

wherein the training simulation is adapted to train the trainee in determining an appropriate target from the objects displayed in the training simulation and judging when to selectively discharge the firearm provided to the trainee at the appropriate target displayed in the training simulation.

5. The method of claim 4 further comprising transferring the training simulation from the host computer system to the client computer system in a compressed format.

6. The method of claim 4 further comprising receiving interaction data from the client computer system at the host computer system, the interaction data being generated in response to the trainee interacting with the training simulation.

7. The method of claim 6, further comprising:

processing a portion of the interaction data received from the client computer system in response to the trainee interacting with the training simulation; and altering the training simulation in a predetermined manner in accordance with the portion of the interaction data.

8. The method of claim 6, comprising:

processing a portion of the interaction data received from the client computer system in response to the trainee interacting with the training simulation; and collecting the interaction data to generate a trainee performance score based on an effectiveness of the trainee interacting with the training simulation.

9. The method of claim 8, further comprising comparing the trainee performance score to a performance standard associated with the training simulation.

10. The method of claim 8, further comprising:

creating a trainee database that at least includes the trainee performance score; and storing the trainee database in a database of the host computer system.

11. The method of claim 10 further comprising enabling the host computer system to transmit a report including the trainee database from the host computer to the client computer upon execution of a command at the client computer system.

* * * * *